US006141914A

United States Patent [19]

Feige et al.

[11] Patent Number: 6,141,914

[45] Date of Patent: Nov. 7, 2000

[54] MOTOR-VEHICLE DOOR-HANDLE ASSEMBLY

[75] Inventors: Stefan Feige, Iserlohn; Thomas Hülsmann, Velbert, both of Germany

[73] Assignee: Kiekert AG, Heiligenhaus, Germany

[21] Appl. No.: 09/349,278

[22] Filed: Jul. 7, 1999

[30] Foreign Application Priority Data

Jul. 8, 1998 [DE] Germany ..... 198 30 516

[51] Int. Cl.[7] ..... E06B 3/00

[52] U.S. Cl. ..... 49/503; 292/DIG. 31; 292/DIG. 53; 70/208

[58] Field of Search ..... 49/503; 292/DIG. 31, 292/DIG. 53; 70/451, 466, 208

[56] References Cited

U.S. PATENT DOCUMENTS 5,238,276 8/1993 Burns ..... 292/DIG. 53 X 5,377,450 1/1995 Varajon ..... 49/503 X 5,499,851 3/1996 Mitchell ..... 292/DIG. 53 X

*Primary Examiner*—Jerry Redman

*Attorney, Agent, or Firm*—Herbert Dubno; Andrew Wilford

[57] ABSTRACT

A door panel formed with a throughgoing hole carries adjacent the hole a shaft pivotal about an axis and having radially projecting retaining formations. An assembly body engaging the panel around the hole carries a movable handle. Retaining formations on the body are engageable with the shaft retaining formations in a predetermined angular holding position of the shaft. The body formations are disengaged from the shaft retaining formations in an angularly offset freeing position of the shaft. The shaft formations are cam lobes and the body has an inwardly extending projection formed with a seat snugly receiving the shaft formations in the holding position of the shaft.

14 Claims, 3 Drawing Sheets

MOTOR-VEHICLE DOOR-HANDLE ASSEMBLY

FIELD OF THE INVENTION

The present invention relates to a motor-vehicle door-handle assembly. More particularly this invention concerns the latch-operating handle mechanism normally used on the outside panel of a motor-vehicle door.

BACKGROUND OF THE INVENTION

A standard motor-vehicle door latch that secures a door to a bolt projecting from a door post is mounted in the door and is operated by a handle assembly fitted to a hole in the outer door panel. This assembly comprises a body which is fixed in the door, a handle movable relative to the body and coupled to the door latch, and structure that secures the body in the door. Often a lock cylinder is also mounted on the body and connected to the latch so it can be used to operate the latch, and in some systems a similar assembly is mounted on an inside door panel.

To speed manufacture, it has been suggested to replace the customary screws and rivets used to secure the body to the door panel with a latching mechanism. In German patent 3,615,440 of Leistner an outside cover plate engages with hooked feet through holes in the door panel and through the assembly body. A slide mounted on the body is formed with holes that can be engaged over these feet to lock the outside cover plate in position and secure the body to the door panel.

Assembly of such a latch is easier than with screws or rivets but still comprises several steps. First the body is fitted to the inside of the door panel at the hole, then the outside cover plate is fitted to the outside face of the panel and with the body. A tool is then inserted through a hole in the door edge and the slide is shifted to lock the parts together. Of course at a later date the slide can be shifted back to allow the assembly to be taken out.

Such a system has several disadvantages. First of all it is fairly cumbersome to install. The installer must dispose of a special tool for the installation and take several steps just to secure the handle assembly in position. Furthermore the slide can move with time and release the outer plate, in particular if suddenly decelerated in a collision.

OBJECTS OF THE INVENTION

It is therefore an object of the present invention to provide an improved motor-vehicle door-handle assembly.

Another object is the provision of such an improved motor-vehicle door-handle assembly which overcomes the above-given disadvantages, that is which is simple to install, is solidly mounted when installed, and which can be removed using a conventional tool.

SUMMARY OF THE INVENTION

A door panel formed with a throughgoing hole carries adjacent the hole a shaft pivotal about an axis and having radially projecting retaining formations. An assembly body engaging the panel around the hole carries a movable handle. Retaining formations on the body are engageable with the shaft retaining formations in a predetermined angular holding position of the shaft. The body formations are disengaged from the shaft retaining formations in an angularly offset freeing position of the shaft. The shaft formations are cam lobes and the body has an inwardly extending projection formed with a seat snugly receiving the shaft formations in the holding position of the shaft.

Thus with this system it is pivoting of the shaft about its axis that moves the retaining formations between their holding and freeing positions. Such rotation is easily effected and is not likely to be caused by any brusque movements of the vehicle.

The projection has an inwardly directed face engageable with the shaft formation on insertion of the body into the hole and fitting of the body to the panel. In addition the projection has a notch forming the seat. The inwardly directed face extends at between 80° and 120° to the horizontal and the notch has a face engaging the shaft formation in the holding position and extending at between 10° and 60° to the horizontal.

According to the invention a support mounted on the door panel is formed with clips rotatably holding the shaft. Furthermore the shaft has an end formed with a tool-receiving socket and the panel has an edge formed with a hole aligned with the socket. A spring engaging the shaft urges it angularly into the holding position. Thus a simple tool, for instance, a standard screwdriver can be inserted through the edge hole in the door and used to move the shaft into the freeing position for removal of the handle assembly. No special-duty tool is needed. What is more, no tools are needed at all for installation of the assembly, since the spring-loaded shaft will automatically pivot out and back to lock the assembly in place as it is inserted through the hole in the door.

The shaft in accordance with the invention is formed with another formation braced against the body in the holding position and the shaft formation is a generally square cam lobe. A flexible seal is provided between an edge of the body and an edge of the hole and the body is provided with a pivot on which the handle is supported.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
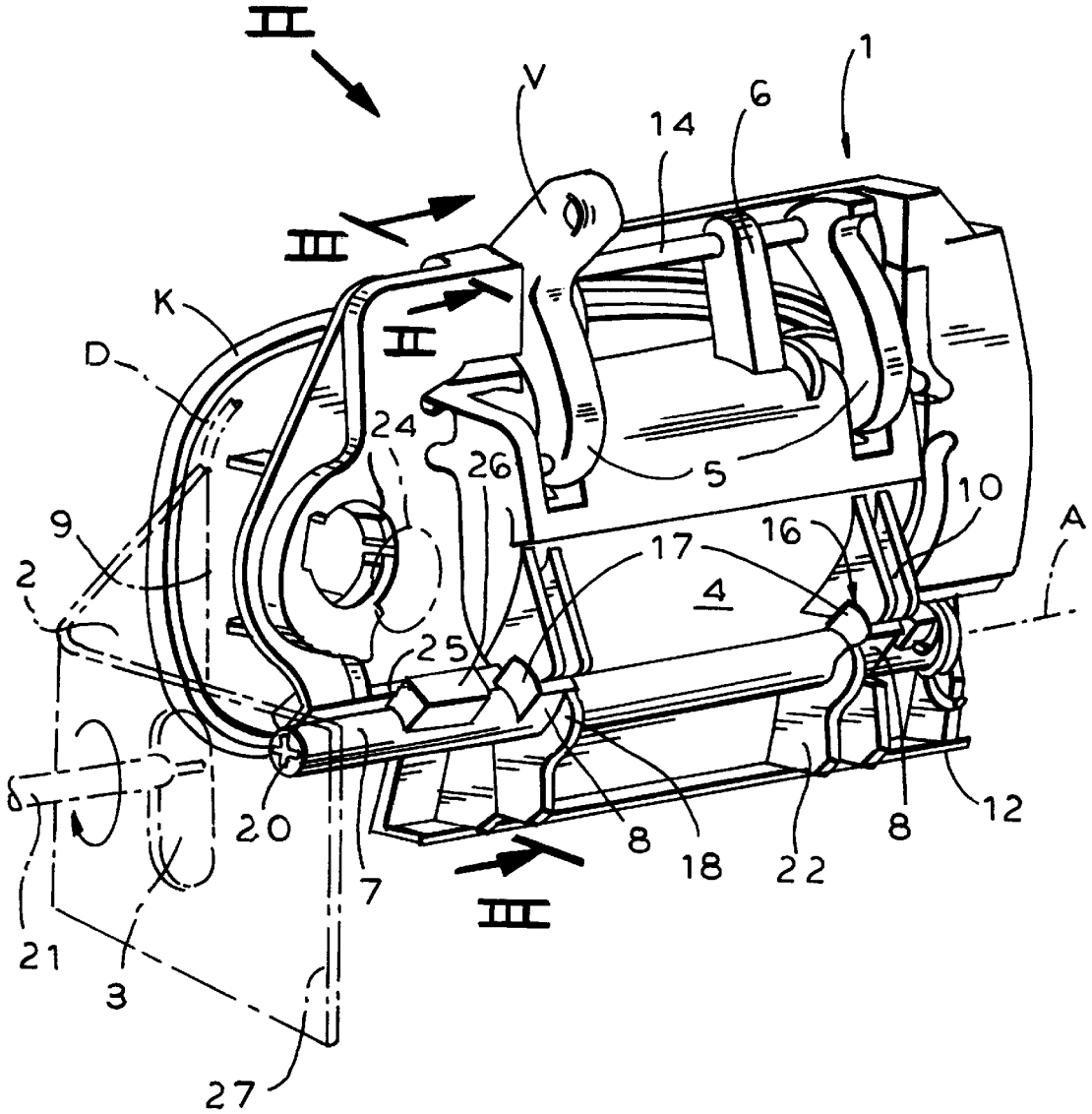
FIG. 1 is a rear perspective view of the motor-vehicle door-handle assembly according to the invention.
Figure 2:
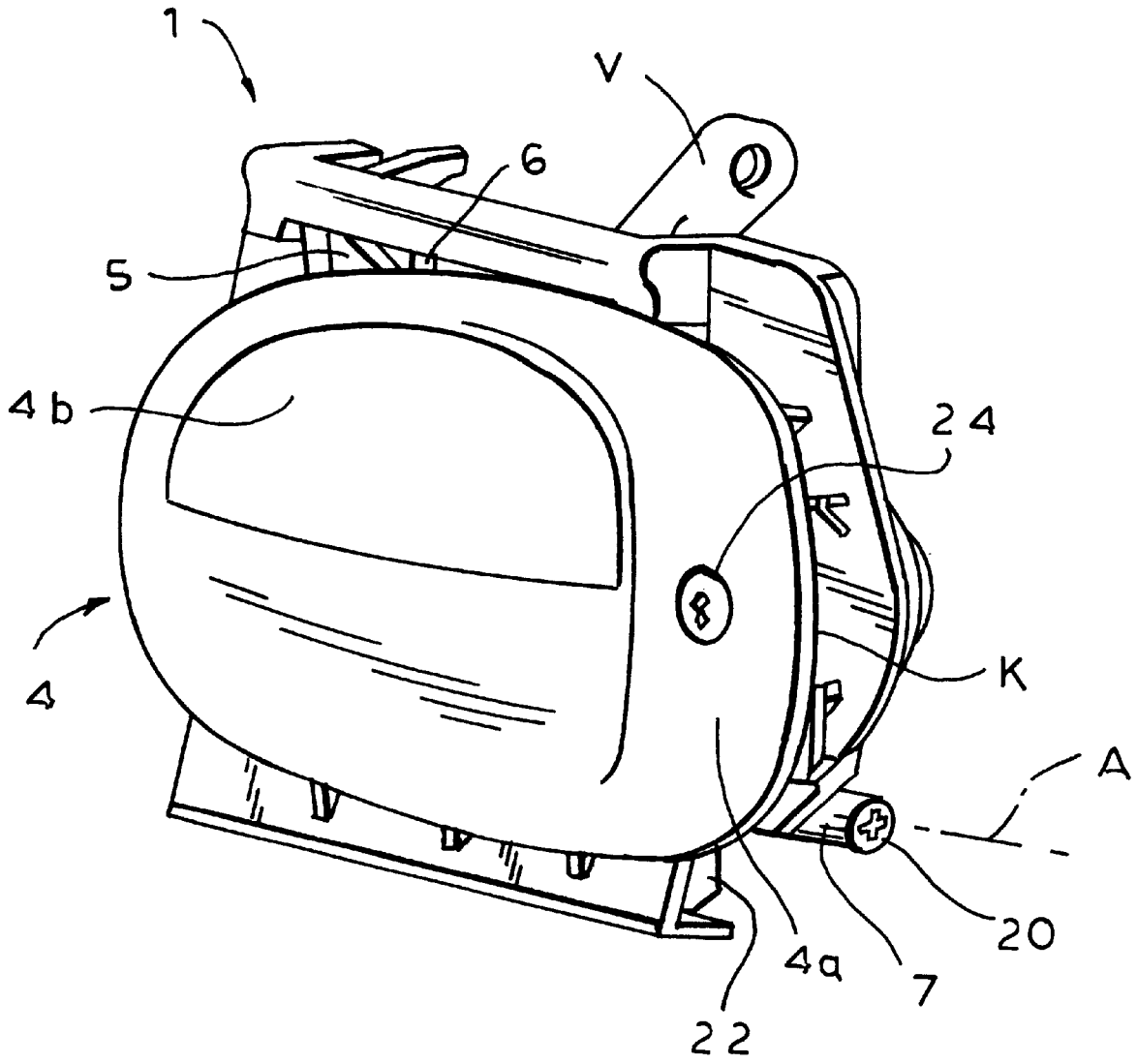
FIG. 2 is a front perspective view taken in the direction of arrow II of FIG. 1.
Figure 3:
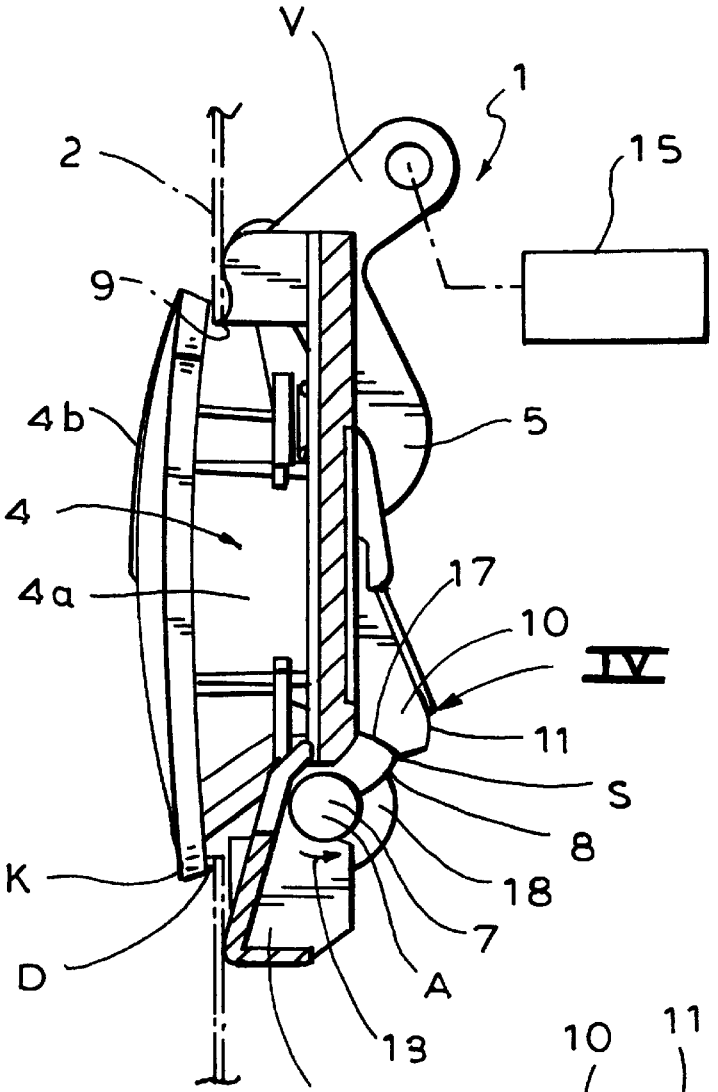
FIG. 3 is a vertical section taken along the plane indicated at lines III of FIG. 1.
Figure 4:
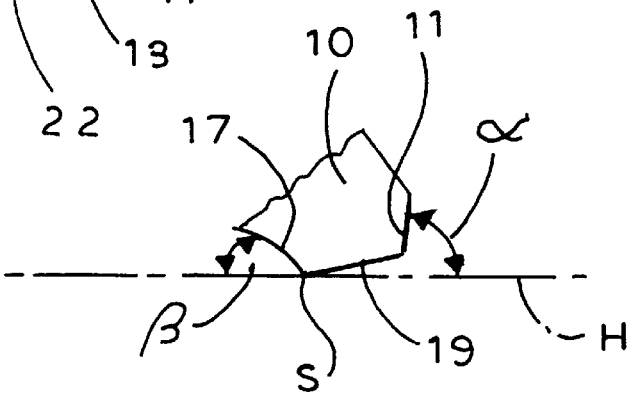
FIG. 4 is a large-scale view of the detail indicated at IV in FIG. 3.

As seen in FIGS. 1 to 3 a door-handle assembly 1 is mounted in a hole 9 formed in an outside panel 2 of a motor-vehicle door. It basically comprises a base plate or body 4 that lies inside the door panel 2 and that has a shell part 4*b* that projects through the hole 9 and carries a handle 4*b*. A seal D lies between a rim of the shell 4*a* and an outer face of the panel 2 and has a lip K engaging around this shell 4*a*.

The body 4 is formed with a pair of gudgeons or pivot blocks 6 (only one shown in FIG. 1) in which is pivoted a pin 14 carrying the outside handle 4*b* via a pair of arms 5 for pivoting of the handle 4*b* about the longitudinal axis of the pin 14 relative to the body 4. One of the arms 5 is formed with an extension V that is connected via a rod or other link illustrated as a dot-dash line to a motor-vehicle door latch 15 offset from the handle assembly 1. A hole 23 in the body 4 carries a lock cylinder 24 that projects through the outside shell 4*a* and is therefore accessible from outside the door. This cylinder 24 can also operate the latch 15.

Mounted inside the door on the panel 2 or other structure therein is a support 22 forming a pair of C-shaped pivots 18 defining a horizontal pivot axis A and holding a mounting rod 7 that can pivot about this axis A. One end of this shaft or rod 7 is formed with a tool-receiving formation 20, here a Phillips socket, that is aligned with a hole 3 in an edge panel 27 of the door. At its opposite end a torque spring 12 engaged around the rod 7 urges it angularly about this axis A in the direction indicated by arrow 13 in FIG. 3. The rod 7 carries a pair of axially offset and outwardly projecting cam lobes 8 and, axially offset therefrom, a second pair of cam lobes 8.

The body 4 of the assembly 1 is formed axially level with each of the lobes 8 with a retaining formation or nose 10 having a surface 11 directed horizontally inward, another surface 17 that is directed angularly downward and that is, in the finished installation, centered on the axis A, and a third surface 19 that is between the surfaces 11 and 17 and that is directed generally downward. Thus each formation 10 forms a notch or seat 16 that can complementarily receive the respective cam lobe 8. The surface 11 forms an angle $\alpha$ of between 80° and 120°, here 90°, to the horizontal H and the surface 17 an average angle $\beta$ of between 10° and 60°, here 20°, to the horizontal H and meets the surface 19 at a point S.

The assembly 1 is mounted according to the invention simply by inserting it from outside (or from inside if the panel 2 is an inside door panel) through the hole 9. The formations 10 will engage with their surfaces 11 against the lobes 8 and will pivot the shaft 7 clockwise as shown in FIG. 3 until the lobes 8 pass the apices S and they come to rest in the seats 16, thereby solidly locking the assembly 1 in place. Separate cam lobes 26 engage surfaces 25 of the body 4 in a rest position from which the shaft 7 is pivoted when the assembly 1 is inserted through the hole 9. To remove it, the screwdriver 21 is inserted in the socket 20 and the shaft 7 is turned clockwise against the force of its spring 12 to move the lobes 8 out of the seats 16, thereby allowing the assembly to be pulled out of the hole 9.

We claim:

1. In combination a door panel formed with a throughgoing hole;

a shaft mounted on the door panel adjacent the hole for pivoting about an axis and having radially projecting shaft retaining formations;

an assembly body engaging the door panel around the hole and carrying a movable handle;

body retaining formations on the body engageable with the shaft retaining formations in a predetermined angular holding position of the shaft, the body retaining formations being disengaged from the shaft retaining formations in an angularly offset freeing position of the shaft.

2. The combination defined in claim 1 wherein the shaft retaining formations are cam lobes and the body has an inwardly extending projection formed with a seat snugly receiving the shaft retaining formations in the holding position of the shaft.

3. The combination defined in claim 2 wherein the projection has an inwardly directed face engageable with one of the shaft retaining formations on insertion of the body into the hole and fitting of the body to the door panel.

4. The combination defined in claim 3 wherein the projection has a notch forming the seat.

5. The combination defined in claim 4 wherein the inwardly directed face extends at between 80° and 120° to the horizontal.

6. The combination defined in claim 5 wherein the notch has a face engaging the shaft retaining formations in the holding position and extending at between 10° and 60° to the horizontal.

7. The combination defined in claim 4, further comprising a support mounted on the door panel and formed with clips rotatably holding the shaft.

8. The combination defined in claim 4 wherein the shaft has an end formed with a tool-receiving socket and the door panel has an edge formed with a hole aligned with the socket.

9. The combination defined in claim 4, further comprising a spring engaging the shaft and urging it angularly into the holding position.

10. The combination defined in claim 4, further comprising a support mounted on the door panel and rotatably holding the shaft.

11. The combination defined in claim 4 wherein the shaft is formed with another formation braced against the body in a rest position.

12. The combination defined in claim 4 wherein the shaft retaining formations are generally square cam lobes.

13. The combination defined in claim 4, further comprising a flexible seal between an edge of the body and an edge of the hole.

14. The combination defined in claim 4 wherein the body is provided with a pivot on which the handle is supported.

* * * * *